US007474943B2

(12) United States Patent
Matsubara et al.

(10) Patent No.: US 7,474,943 B2
(45) Date of Patent: Jan. 6, 2009

(54) REMOTE STARTING DEVICE AND REMOTE STARTING METHOD

(75) Inventors: Manabu Matsubara, Kobe (JP); Minoru Yoshimura, Kobe (JP)

(73) Assignee: Fujitsu Ten Limited, Hyogo (JP)

( * ) Notice: Subject to any disclaimer, the term of this patent is extended or adjusted under 35 U.S.C. 154(b) by 717 days.

(21) Appl. No.: 10/886,718

(22) Filed: Jul. 9, 2004

(65) Prior Publication Data

US 2005/0010336 A1 Jan. 13, 2005

(30) Foreign Application Priority Data

Jul. 11, 2003 (JP) ..... 2003-196047

(51) Int. Cl.
*F02D 41/06* (2006.01)
*F02N 11/08* (2006.01)

(52) U.S. Cl. ..... 701/2; 701/113; 123/179.2

(58) Field of Classification Search ..... None
See application file for complete search history.

(56) References Cited

U.S. PATENT DOCUMENTS 4,598,209 A * 7/1986 Garlinghouse ..... 290/38 C
4,674,454 A * 6/1987 Phairr ..... 123/179.2
5,054,569 A * 10/1991 Scott et al. ..... 180/167
5,942,988 A * 8/1999 Snyder et al. ..... 340/825.69
6,853,895 B2 * 2/2005 Javaherian ..... 701/36

FOREIGN PATENT DOCUMENTS

JP 6-1748 1/1994
JP 09-112393 * 4/1997

OTHER PUBLICATIONS

English language abstract of JP 10-252519 published Sep. 1998.
English language abstract of JP 10-252623 published Sep. 1998.

* cited by examiner

*Primary Examiner*—Michael J. Zanelli
(74) *Attorney, Agent, or Firm*—Wenderoth, Lind & Ponack, L.L.P.

(57) ABSTRACT

A remote starting device prevents the temperature of exhaust gas from being made too high or the amount of toxic gas around a vehicle from being made too large by engine starting by remote control. The remote starting device controls a starter for starting an engine of the vehicle when receiving an engine start command from a portable transmitter. The remote starting device includes a section for deciding whether the engine starting has been frequently conducted, and a section for limiting the engine starting through receiving the engine start command from the portable transmitter when it is decided that the engine starting has been frequently conducted.

2 Claims, 13 Drawing Sheets

REMOTE STARTING DEVICE AND REMOTE STARTING METHOD

BACKGROUND OF THE INVENTION

1. Field of the Invention

The present invention relates to a remote starting device and a remote starting method and, more particularly, to a remote starting device and a remote starting method for starting an engine of a vehicle by remote control.

2. Description of the Relevant Art

Lately, a remote starting device which starts an engine of a vehicle by remote control has been commercially practical (for example, see Japanese Utility Model Application No. 1994-1748 and Japanese Kokai No. 1998-252519). FIG. 11 is a block diagram schematically showing the principal part of an engine starting system comprising a conventional remote starting device.

When an ignition key 1 is inserted into a key cylinder 2 by a user and is turned to the starter position, an ACC signal, an IG signal and a starter signal are provided from the key cylinder 2 to an engine controller 3. When receiving these signals, the engine controller 3 activates a self starter motor 4 so as to start an engine.

To the remote starting device 5, a key detector 6 for detecting that the ignition key 1 has been inserted in the key cylinder 2, a door opening/closing detector 7 for detecting the opening/closing of doors, a parking brake application detector 8 for detecting the application of a parking brake and a selector lever position detector 9 for detecting in which position a selector lever is are connected. In the remote starting device 5, that the ignition key 1 has been inserted in the key cylinder 2, the open/closed state of the doors, that the parking brake is applied and that the selector lever is in the parking position can be recognized.

When receiving a signal instructing to start the engine from a transmitter 10 being carried by the user, the remote starting device 5 judges whether the signal is proper (or whether the signal is not a signal sent from any transmitter other than the transmitter 10). When the signal is judged to be proper, whether a remote starting condition (for example, the ignition key 1 has not been inserted in the key cylinder 2, the doors are closed, the parking brake is applied and the selector lever is in the parking position) has been met is judged. When it is judged that the remote starting condition has been met, an ACC relay 5*a*, an IG relay 5*b* and a ST relay 5*c* are rendered in the ON state so as to provide the ACC signal, IG signal and starter signal to the engine controller 3. Here, the ACC relay 5*a* and IG relay 5*b* are kept in the ON state until the engine is stopped, while the ST relay 5*c* is kept in the ON state for a few seconds (e.g. 2-3 seconds).

When receiving these signals, the engine controller 3 activates the self starter motor 4 so as to start the engine, similarly to the case where the ignition key 1 is inserted into the key cylinder 2 and is turned to the starter position. FIG. 12 shows a timing chart from the reception of a signal instructing to start the engine transmitted from the transmitter 10 to a start of the engine.

If a preset time (e.g. 10-15 minutes) elapsed in a state where the remote starting condition has been met after the engine start, the remote starting device 5 turns the ACC relay 5*a* and IG relay 5*b* to the OFF state so as to stop providing the ACC signal and IG signal to the engine controller 3. When the engine controller 3 comes not to receive these signals, it stops driving the self starter motor 4 so as to stop the engine. FIG. 13 shows a timing chart from the reception of a signal instructing to start the engine transmitted from the transmitter 10 through a start of the engine up to a stop of the engine. Thus, in the case of starting the engine by remote control, a warm-up is conducted for the preset time.

The engine started by remote control continues running in a state where the vehicle has been parked. Therefore, if the warm-up continues for a long time, the temperature of exhaust gas emitted from the engine becomes too high and the heat in a muffler or the like remains, so that there is a risk of fire if there is something flammable near the muffler.

The exhaust gas emitted from the vehicle sometimes contains toxic gas (such as carbon monoxide, nitrogen oxides and hydrocarbon). If the warm-up continues for a long time similarly to the above, the amount of toxic gas around the vehicle becomes too large in some cases. Particularly, when the engine starting by remote control is conducted on a vehicle housed in a garage, there is a risk that toxic gas fills the garage, resulting in a dangerous situation. Therefore, if the engine starting by remote control is conducted and the warm-up is repeatedly conducted, there is a risk of fire or a dangerous situation as described above.

In order to solve the above problems, methods disclosed in Japanese Utility Model Application No. 1994-1748 and Japanese Kokai No. 1998-252519 are exemplified, wherein an exhaust temperature sensor or a gas sensor for detecting a toxic gas concentration is mounted on a vehicle, and the engine is stopped when the output level from the exhaust temperature sensor or gas sensor reaches a prescribed value or more. However, the exhaust temperature sensor or gas sensor is not so low priced.

SUMMARY OF THE INVENTION

The present invention was developed in order to solve the above problem, and it is an object of the present invention to provide a remote starting device and a remote starting method, which can prevent the temperature of exhaust gas from being made too high or the amount of toxic gas around a vehicle from being made too large by engine starting by remote control.

In order to achieve the above object, a remote starting device according to the first aspect of the present invention is characterized by being a remote starting device having a starter for starting an engine of a vehicle when receiving an engine start command from a transmitter, which comprises a starting situation decision section for deciding whether engine starting through receiving the command from the transmitter has been frequently conducted or comes to be frequently conducted and a limiter for limiting the engine starting through receiving the command from the transmitter when it is decided that the engine starting has been frequently conducted or comes to be frequently conducted by the starting situation decision section.

Using the remote starting device according to the first aspect of the present invention, when it is decided that the engine starting has been frequently conducted or comes to be frequently conducted (for example, the engine starting has been or comes to be conducted intensively within a preset period of time)(or when there is a possibility that a warm-up continues for a long time, or that the total time of warm-ups becomes long even if they were intermittently conducted), the engine starting through receiving the command from the transmitter is limited. Here, as a method for limiting the engine starting, prohibiting the engine starting or shortening the engine running time is exemplified.

Therefore, it is possible to avoid the occurrence of events in which the temperature of exhaust gas emitted from the engine becomes too high, so that the heat in a muffler or the like remains, or the amount of toxic gas around the vehicle becomes too large, because a warm-up continues for a long time, or the total time of warm-ups becomes long even if they were intermittently conducted.

A remote starting device according to the second aspect of the present invention is characterized by comprising a condition satisfaction judgment section for judging whether a predetermined resetting condition was met and a first resetter for resetting the decision by the starting situation decision section when it is judged that the predetermined resetting condition was met by the condition satisfaction judgment section in the remote starting device according to the first aspect of the present invention.

When the user can grasp the situation around the vehicle, the possibility that the engine starting is frequently repeated up to a dangerous situation is low. Once the vehicle is started, the problem as described above is not caused. And when the user got on the vehicle, there is a high possibility that the vehicle will be started soon.

Using the remote starting device according to the second aspect of the present invention, when it is judged that the predetermined resetting condition was met (for example, when it is detected that the user is near the vehicle, that the user got on the vehicle or that the vehicle was once started), the decision by the starting situation decision section (or the decision on whether or not the engine starting has been frequently conducted or comes to be frequently conducted) is reset. Thus, it is possible to prevent the engine starting from being limited more than necessary, resulting in an improvement in convenience with safety of the engine starting by remote control maintained.

A remote starting device according to the third aspect of the present invention is characterized by the predetermined resetting condition which includes that the presence of an authorized user of the vehicle around the vehicle or the presence of the authorized user within the vehicle is detected in the remote starting device according to the second aspect of the present invention.

Using the remote starting device according to the third aspect of the present invention, since the predetermined resetting condition includes that the presence of an authorized user of the vehicle around the vehicle or the presence of the authorized user within the vehicle is detected, the decision can be reset in response to that the authorized user is around the vehicle or that the authorized user got on the vehicle.

Therefore, when the engine starting has been frequently conducted or comes to be frequently conducted (for example, the engine starting is consecutively conducted three times) in a state where the authorized user is away from the vehicle (or is not on the vehicle), the engine starting through receiving the command from the transmitter is limited. In other words, when even if the engine starting was consecutively conducted three times, the user got on the vehicle during that, the engine starting through receiving the command from the transmitter is not limited. Thus, the limitation can be applied only when necessary.

Here, as a method for detecting the presence of the authorized user around or within the vehicle, detecting the opening of a door of the vehicle, an insertion of an ignition key into a key cylinder, turning-on of an ACC switch, turning-on of an IG switch, no application of a parking brake or a shift of a selector lever to any position other than the parking position is exemplified.

A remote starting device according to the fourth aspect of the present invention is characterized by the starting situation decision section which decides whether the engine starting has been frequently conducted or comes to be frequently conducted based on the number of times of the engine starting in the remote starting device according to the first aspect of the present invention.

Using the remote starting device according to the fourth aspect of the present invention, whether the engine starting has been or comes to be frequently conducted is decided based on the number of times of the engine starting. Therefore, the engine starting by remote control is limited depending on the number of repetitions of the engine starting, so that the limitation can be more appropriately conducted.

A remote starting device according to the fifth aspect of the present invention is characterized by the starting situation decision section which has a function of judging whether the number of times of the engine starting is a first prescribed number of times or more and decides that the engine starting has been frequently conducted when judging that the number of times of the engine starting is the first prescribed number of times or more in the remote starting device according to the fourth aspect of the present invention.

Using the remote starting device according to the fifth aspect of the present invention, when it is judged that the number of times of the engine starting is the first prescribed number of times (e.g. three times), it is decided that the engine starting has been frequently conducted. Thus, it is possible to prevent a fourth engine start from being conducted by the engine start command from the transmitter (or by remote control). For example, it is possible to prevent the engine starting by remote control from being conducted four times or more in a state where the user is not on the vehicle. Thus, it is possible to prevent the temperature of exhaust gas from becoming too high or the amount of toxic gas around the vehicle from becoming too large.

A remote starting device according to the sixth aspect of the present invention is characterized by comprising a first elapse judgment section for judging whether an elapsed time between an engine stop and the next engine start is within a first preset time, wherein the starting situation decision section has a function of judging whether the engine starting within the first preset time after the engine stop has been continued a second prescribed number of times based on the judgment result by the first elapse judgment section and decides that the engine starting has been frequently conducted when judging that the engine starting within the first preset time after the engine stop has been continued the second prescribed number of times in the remote starting device according to the fourth aspect of the present invention.

Using the remote starting device according to the sixth aspect of the present invention, when it is judged that the engine starting has been continued the second prescribed number of times (e.g. 3 times) within the first preset time (e.g. 30 minutes) after the engine stop (or when the engine starting was repeatedly conducted at short intervals), it is decided that the engine starting has been frequently conducted.

Thus, for example, when the engine starting was repeated three times at short intervals within 30 minutes, it is possible to prevent a fourth engine start by the engine start command from the transmitter (or by remote control). Therefore, since the engine starting is not conducted four times at short intervals, it is possible to certainly avoid a warm-up from continuing for a long time.

Here, the first preset time may be varied according to the number of times of the engine starting or the elapsed time between the engine stop before last and the last engine start. For example, the first preset time may be set to be 30 minutes between a first start and a second start, and the first preset time may be set to be 20 minutes between the second start and a third start. And if the elapsed time is 25 minutes, being comparatively long, the first preset time may be 30 minutes as it is, and if the elapsed time is 5 minutes, being comparatively short, the first preset time may be shortened to 10 minutes.

A remote starting device according to the seventh aspect of the present invention is characterized by the starting situation decision section which has a function of judging whether the number of times of the engine starting within a first preset period of time is a third prescribed number of times or more and decides that the engine starting has been frequently conducted when judging that the number of times of the engine starting within the first preset period of time is the third prescribed number of times or more in the remote starting device according to the fourth aspect of the present invention.

Using the remote starting device according to the seventh aspect of the present invention, when it is judged that the number of times of the engine starting within the first preset period of time (for example, within 60 minutes from the first engine start after the user went away from the vehicle) is the third prescribed number of times (e.g. 3 times), it is decided that the engine starting has been frequently conducted. For example, when the engine starting is conducted three times within 60 minutes, being not so long, the engine starting through receiving the command from the transmitter can be prohibited. Thus, it is possible to prevent the temperature of exhaust gas from becoming too high or the amount of toxic gas around the vehicle from becoming too large.

A remote starting device according to the eighth aspect of the present invention is characterized by comprising a second elapse judgment section for judging whether a second preset time has elapsed since an engine stop, a limit canceller for canceling the limitation on the engine starting by the limiter when it is judged that the second preset time has elapsed since the engine stop by the second elapse judgment section, and a second resetter for resetting the number of times of the engine starting in response to the cancellation of the limitation on the engine starting by the limit canceller in the remote starting device according to the first aspect of the present invention.

Using the remote starting device according to the first aspect of the present invention, when it is decided that the engine starting has been frequently conducted, the engine starting through receiving the command from the transmitter is limited, so that it is possible to prevent the temperature of exhaust gas from becoming too high or the amount of toxic gas around the vehicle from becoming too large.

Using the remote starting device according to the eighth aspect of the present invention, the limitation on the engine starting by the limiter is canceled when it is judged that the second preset time (e.g. 30 minutes) has elapsed since the engine stop (or when it is judged to be safe because a measure of time has elapsed since the engine stop), resulting in an improvement in convenience with keeping safety.

A remote starting device according to the ninth aspect of the present invention is characterized by comprising a third elapse judgment section for judging whether an elapsed time between an engine stop and the next engine start is not more than a third preset time, wherein the starting situation decision section decides that the engine starting comes to be frequently conducted when it is judged that the elapsed time between the engine stop and the next engine start is not more than the third preset time by the third elapse judgment section in the remote starting device according to the first aspect of the present invention.

Using the remote starting device according to the ninth aspect of the present invention, when it is judged that the elapsed time between the engine stop and the next engine start is not more than the third preset time (e.g. 30 minutes) (or when the engine starting comes to be repeated at a short interval), it is decided that the engine starting comes to be frequently conducted due to the next engine start. Thus, for example, it is possible to prevent the engine starting from being repeated at a short interval within 30 minutes, so that it is possible to certainly avoid a warm-up from continuing for a long period of time.

A remote starting device according to the tenth aspect of the present invention is characterized by the starting situation decision section which has a function of judging whether the number of times of the engine starting within a second preset period of time becomes a fourth prescribed number of times or more due to the next engine start and decides that the engine starting comes to be frequently conducted when judging that the number of times of the engine starting within the second preset period of time becomes the fourth prescribed number of times or more in the remote starting device according to the first aspect of the present invention.

Using the remote starting device according to the tenth aspect of the present invention, when it is judged that the number of times of the engine starting within the second preset period of time (for example, within 60 minutes from the first engine start after the user went away from the vehicle) becomes the fourth prescribed number of times (e.g. 4 times), it is decided that the engine starting comes to be frequently conducted. For example, it is possible to prohibit the engine starting from being conducted four times within 60 minutes, being not so long. Thus, it is possible to prevent the temperature of exhaust gas from becoming too high or the amount of toxic gas around the vehicle from becoming too large.

A remote starting device according to the eleventh aspect of the present invention is characterized by setting at least one parameter from among the first through fourth prescribed numbers of times, the first through third preset times and the first or second preset period of time based on information regarding environments of the vehicle in the remote starting device according to the fifth aspect of the present invention.

Using the remote starting device according to the eleventh aspect of the present invention, based on information regarding the environments of the vehicle (such as the temperature of exhaust gas emitted from the vehicle, the amount of toxic gas around the vehicle, the temperature around the vehicle and the location where the vehicle is), at least one parameter is set from among the first through fourth prescribed numbers of times, the first through third preset times and the first or second preset period of time.

For example, when the temperature of exhaust gas emitted from the vehicle is low, when the amount of toxic gas around the vehicle is small, when the temperature around the vehicle is low, or when the vehicle is parked not within a garage but in an open wide space, the threshold level for limiting the engine starting may be made higher so that the limitation on the engine starting is loosened. Therefore, by setting parameters in the above-described manner, it is possible to further improve the convenience with keeping the safety in the engine starting by remote control.

A remote starting device according to the twelfth aspect of the present invention is characterized by comprising a notification section for notifying the user that the engine starting is limited by the limiter when the engine start command from the transmitter is received in the remote starting device according to the first aspect of the present invention.

Using the remote starting device according to the twelfth aspect of the present invention, since the user is informed that the engine starting is limited by the limiter, the user can know the reason why the engine is not started by remote control.

A remote starting device according to the thirteenth aspect of the present invention is characterized by being a remote starting device having a starter for remote starting an engine of a vehicle in response to an engine start command from a transmitter, which comprises a detector for detecting the frequency of the remote starting and a limiter for limiting the remote starting according to the frequency of the remote starting detected by the detector.

Using the remote starting device according to the thirteenth aspect of the present invention, the remote starting is limited depending on the frequency of the remote starting. Here, as a method for limiting the engine starting, prohibiting the engine starting or shortening the engine running time is exemplified.

Therefore, it is possible to avoid the occurrence of events in which the temperature of exhaust gas emitted from the engine becomes too high, so that the heat in a muffler or the like remains, or the amount of toxic gas around the vehicle becomes too large, because a warm-up continues for a long time, or the total time of warm-ups (the cumulative running time) becomes long even if they were intermittently conducted.

A remote starting device according to the fourteenth aspect of the present invention is characterized by the limiter which prohibits the remote starting when the number of times of the remote starting within a preset period of time exceeds a prescribed number of times in the remote starting device according to the thirteenth aspect of the present invention.

Using the remote starting device according to the fourteenth aspect of the present invention, when it is judged that the number of times of the remote starting exceeds the prescribed number of times (e.g. 3 times), it is decided that the remote starting has been frequently conducted, so that the remote starting is prohibited. Thus, it is possible to prevent a fourth engine start from being conducted by the engine start command from the transmitter (or by remote control). For example, it is possible to prevent the engine starting by remote control from being conducted four times or more in a state where the user is not on the vehicle.

A remote starting device according to the fifteenth aspect of the present invention is characterized by comprising a measuring section for measuring a cumulative running time of the engine by the remote starting within a preset period of time, wherein the limiter prohibits the remote starting when the number of times of the remote starting within the preset period of time exceeds a prescribed number of times or when the cumulative running time measured by the measuring section exceeds a preset time in the remote starting device according to the thirteenth aspect of the present invention.

Using the remote starting device according to the fifteenth aspect of the present invention, the remote starting is prohibited when the number of times of the remote starting within the preset period of time exceeds the prescribed number of times, and the remote starting is also prohibited when the cumulative running time of the engine by the remote starting within the preset period of time exceeds the preset time. Therefore, the remote starting is prohibited even if the frequency of the remote starting is not high, when the cumulative running time of the engine by the remote starting within the preset period of time is long. Thus, it is possible to more reliably prohibit the remote starting when necessary.

A remote starting device according to the sixteenth aspect of the present invention is characterized by being a remote starting device having a starter for remote starting an engine of a vehicle in response to an engine start command from a transmitter, comprising a measuring section for measuring a cumulative running time of the engine by the remote starting within a preset period of time and a limiter for limiting the remote starting according to the cumulative running time measured by the measuring section.

Using the remote starting device according to the sixteenth aspect of the present invention, the remote starting is limited depending on the cumulative running time of the engine by the remote starting within the preset period of time. Here, as a method for limiting the engine starting, prohibiting the engine starting or shortening the engine running time is exemplified.

Therefore, it is possible to avoid the occurrence of events in which the temperature of exhaust gas emitted from the engine becomes too high, so that the heat in a muffler or the like remains, or the amount of toxic gas around the vehicle becomes too large, because a warm-up continues for a long time, or the total time of warm-ups (the cumulative running time) becomes long even if they were intermittently conducted.

A remote starting device according to the seventeenth aspect of the present invention is characterized by the preset period of time which is a period between the closing of a door of the vehicle and the next opening of a door of the vehicle in the remote starting device according to the fourteenth aspect of the present invention.

Using the remote starting device according to the seventeenth aspect of the present invention, since the preset period of time is a period between the closing of the door of the vehicle and the next opening thereof (or a period between the user's going away from the vehicle and coming back), the remote starting is limited when the user is neither around the vehicle nor within the vehicle.

In other words, it is possible not to limit the remote starting in a situation where the user can monitor the vehicle. Therefore, it is possible to prevent the remote starting from being limited more than necessary, resulting in an improvement in convenience with safety of the engine starting by remote control maintained.

A remote starting device according to the eighteenth aspect of the present invention is characterized by comprising a resetter for resetting information used for deciding whether the remote starting should be limited when a predetermined condition was met in the remote starting device according to the thirteenth aspect of the present invention.

Using the remote starting device according to the eighteenth aspect of the present invention, when the prescribed condition was met (for example, when it is detected that the user is near the vehicle, that the user got on the vehicle, or that the vehicle was started once), the information used for the decision on whether the limitation on the remote starting should be conducted is reset. Thus, it is possible to prevent the engine starting from being limited more than necessary, resulting in an improvement in convenience with safety of the engine starting by remote control maintained.

A remote starting device according to the nineteenth aspect of the present invention is characterized by the predetermined condition which is the opening of a door of the vehicle in the remote starting device according to the eighteenth aspect of the present invention.

Using the remote starting device according to the nineteenth aspect of the present invention, since the predetermined condition is the opening of the door of the vehicle, the judgment on whether the user is near the vehicle (or the judgment on the timing for resetting) can be made with good accuracy. Thus, the resetting can be appropriately conducted.

A remote starting device according to the twentieth aspect of the present invention is characterized by being a remote starting device having a starter for remote starting an engine of a vehicle in response to an engine start command from a transmitter, comprising a judgment section for judging whether an elapsed time between an engine stop and the next engine start is shorter than a preset time and a prohibitor for prohibiting the remote starting when it is judged that the elapsed time is shorter than the preset time by the judgment section.

Using the remote starting device according to the twentieth aspect of the present invention, when the elapsed time between the engine stop and the next engine start is shorter than the preset time, the remote starting is prohibited. That is, it is possible to avoid the occurrence of events in which the temperature of exhaust gas emitted from the engine becomes too high, so that the heat in a muffler or the like remains, or the amount of toxic gas around the vehicle becomes too large, because the total time of warm-ups becomes long even if they were intermittently conducted.

A remote starting method according to the first aspect of the present invention is characterized by being a remote starting method for remote starting an engine of a vehicle in response to an engine start command from a transmitter, comprising the steps of detecting the frequency of the remote starting, judging whether the frequency of the remote starting exceeded a prescribed value, and limiting the remote starting when it is judged that the frequency of the remote starting exceeded the prescribed value.

Using the remote starting method according to the first aspect of the present invention, when the frequency of the remote starting exceeded the prescribed value, the remote starting is limited. Here, as a method for limiting the engine starting, prohibiting the engine starting or shortening the engine running time is exemplified.

Therefore, it is possible to avoid the occurrence of events in which the temperature of exhaust gas emitted from the engine becomes too high, so that the heat in a muffler or the like remains, or the amount of toxic gas around the vehicle becomes too large, because a warm-up continues for a long time, or the total time of warm-ups becomes long even if they were intermittently conducted.

A remote starting method according to the second aspect of the present invention is characterized by being a remote starting method for remote starting an engine of a vehicle in response to an engine start command from a transmitter, comprising the steps of judging whether the number of times of the remote starting exceeded a prescribed number of times within a period between the closing of a door of the vehicle and the next opening of a door of the vehicle, and prohibiting the remote starting when it is judged that the number of times of the remote starting exceeded the prescribed number of times within the period.

Using the remote starting method according to the second aspect of the present invention, when the number of times of the remote starting exceeded the prescribed number of times within the period between the closing of the door of the vehicle and the next opening thereof (or a period between the user's going away from the vehicle and coming back), the remote starting is prohibited. Therefore, the remote starting is prohibited when the user is neither around the vehicle nor within the vehicle.

In other words, it is possible not to prohibit the remote starting in a situation where the user can monitor the vehicle. Therefore, it is possible to prevent the remote starting from being prohibited more than necessary, resulting in an improvement in convenience with safety of the engine starting by remote control maintained.

DESCRIPTION OF THE PREFERRED EMBODIMENTS

Figure 1:
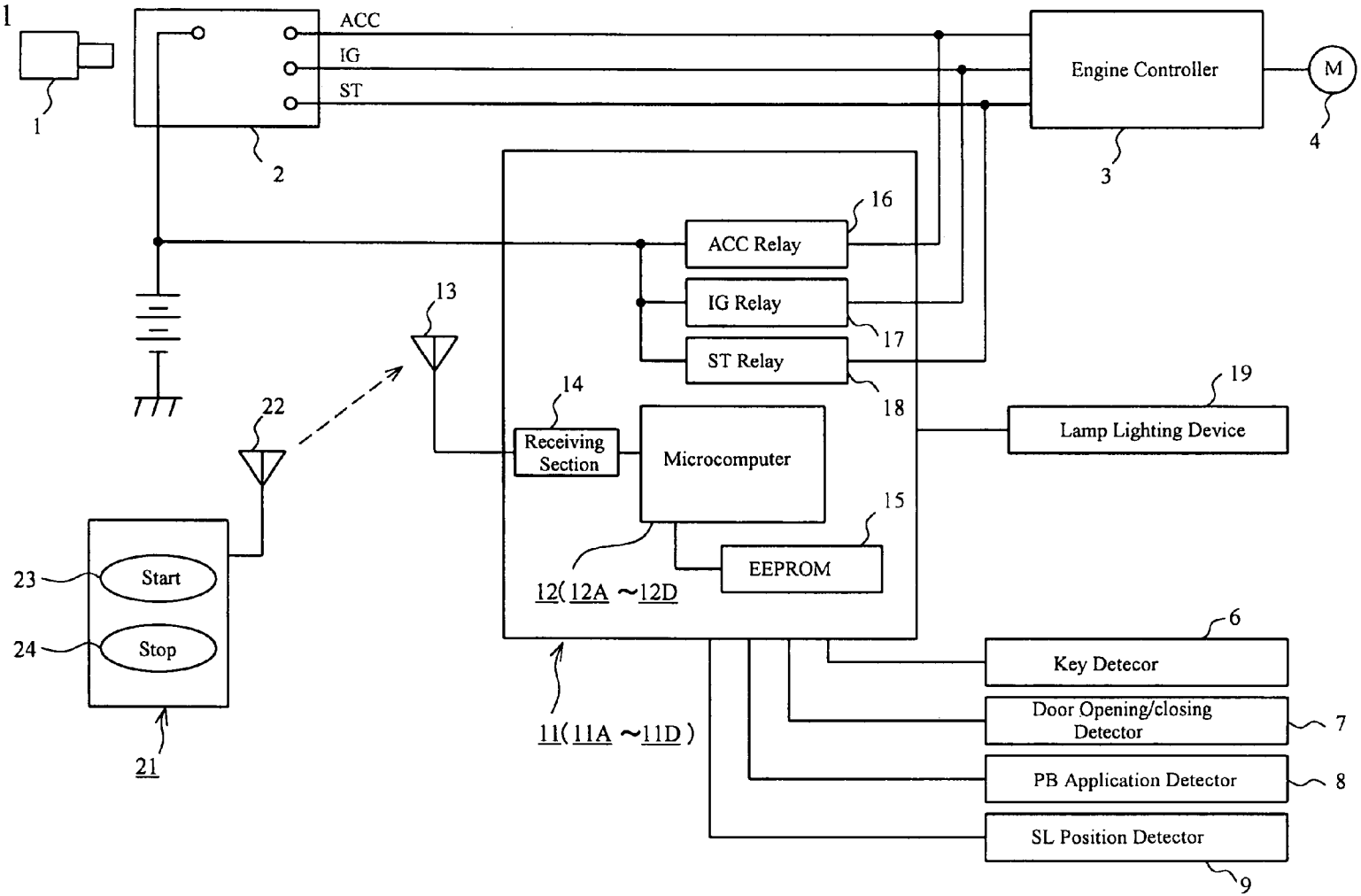
FIG. 1 is a block diagram schematically showing the principal part of an engine starting system comprising a remote starting device according to a first embodiment of the present invention.
Figure 11:
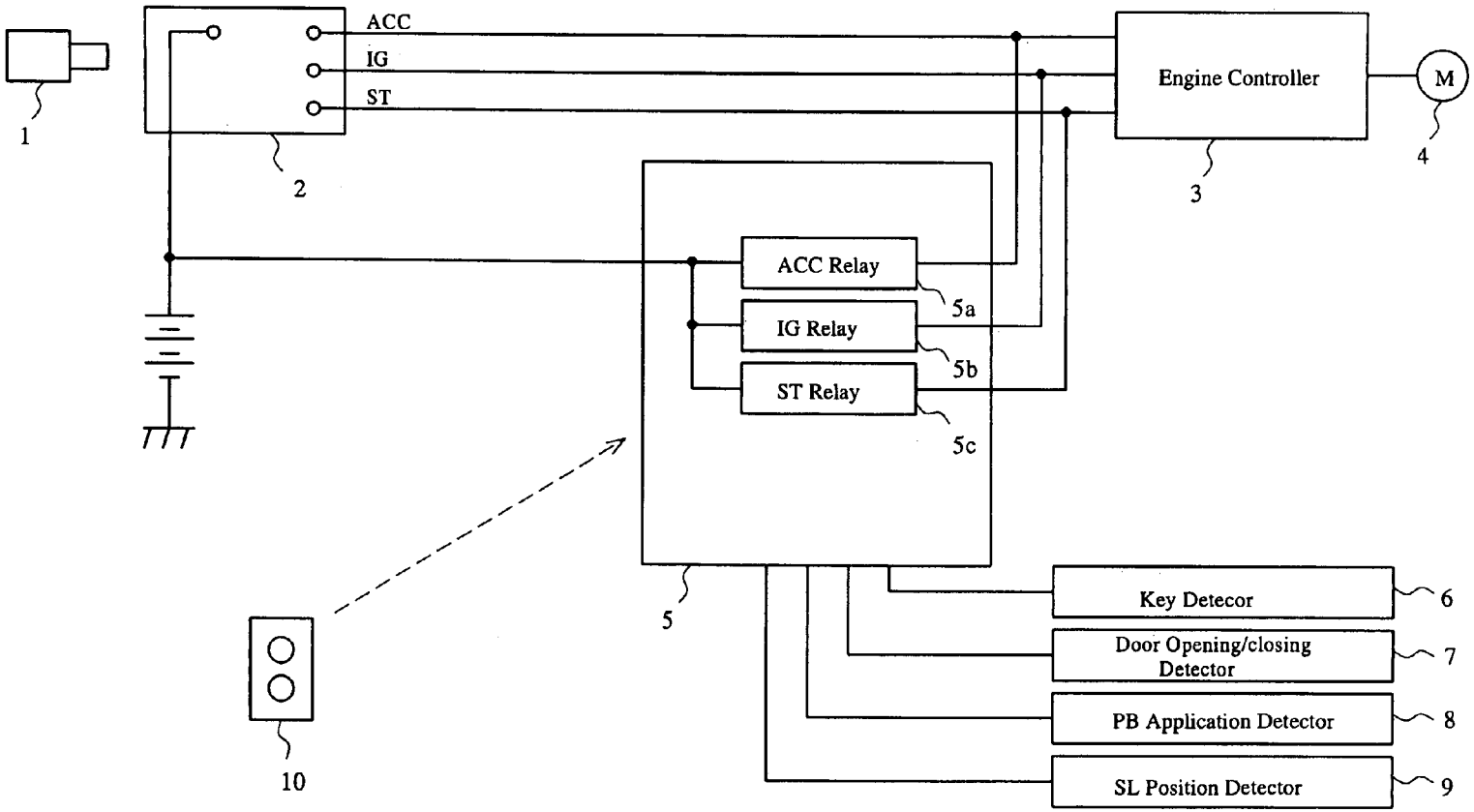
Fig.11 PRIOR ART
FIG. 11 is a block diagram schematically showing the principal part of an engine starting system comprising a conventional remote starting device.
Figure 12:
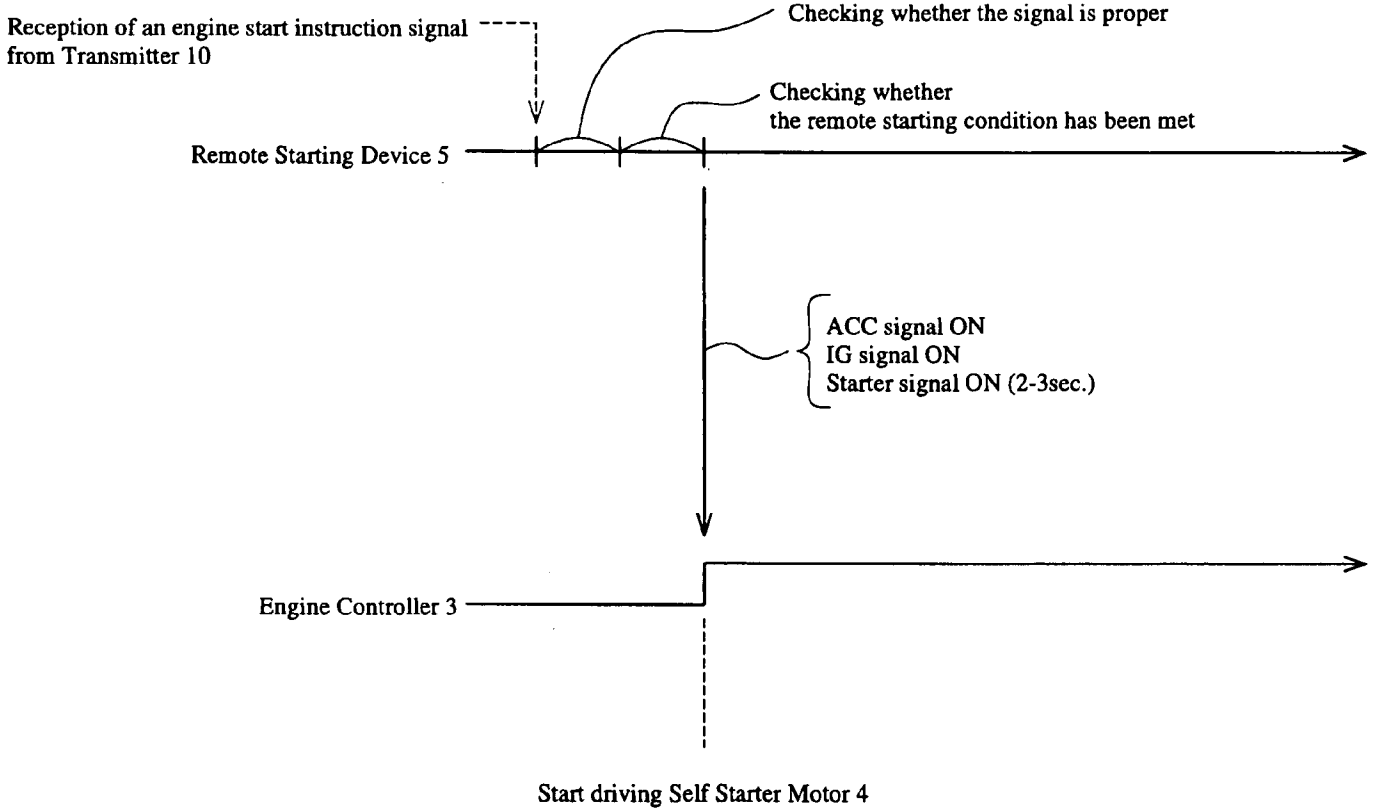
FIG. 12 is a timing chart showing a flow from the reception of a signal instructing to start an engine transmitted from a transmitter to an engine start.

The preferred embodiments of the remote starting device and the remote starting method according to the present invention are described below by reference to the Figures of the drawings. FIG. 1 is a block diagram schematically showing the principal part of an engine starting system comprising a remote starting device according to a first embodiment. Here, the same components as those in the engine starting system shown in FIG. 11 are similarly marked and are not described below.

Reference numeral 11 in the figure represents a remote starting device, comprising a microcomputer 12, an antenna 13 and a receiving section 14 for receiving signals sent from a portable transmitter 21, an EEPROM 15 in which an ID code is stored, an ACC relay 16, an IG relay 17 and a ST relay 18.

To the remote starting device 11, a key detector 6 for detecting that an ignition key 1 was inserted, a door opening/closing detector 7 for detecting the opening/closing of doors, a parking brake application detector 8 for detecting the application of a parking brake and a selector lever position detector 9 for detecting in which position a selector lever is are connected. In the remote starting device 11, that the ignition key 1 has been inserted in a key cylinder 2, the open/closed state of the doors, that the parking brake has been applied and that the selector lever is in the parking position can be recognized thereby. And the remote starting device 11 can control a lamp lighting device 19 so as to light a hazard flasher.

The portable transmitter 21 comprises a microcomputer (not shown), an antenna 22 and a transmitting section (not shown) for sending a prescribed signal to the remote starting device 11, an EEPROM (not shown) in which an ID code is stored, and a button switch 23 for instructing to start an engine by remote control and a button switch 24 for instructing to stop the engine thereby.

When the button switch 23 is pressed, the microcomputer of the portable transmitter 21 sends a signal including the ID code and an engine start command code through the antenna 22 to the outside, while the microcomputer thereof sends a signal including the ID code and an engine stop command code through the antenna 22 to the outside when the button switch 24 is pressed.

When receiving a signal instructing to start the engine from the portable transmitter 21 being carried by its user, the remote starting device 11 judges whether the signal is proper (or whether the signal was not sent from any transmitter other than the portable transmitter 21). When the signal is judged to be proper, whether a remote starting condition (for example, the ignition key 1 has not been inserted in the key cylinder 2, the doors are closed, the parking brake is applied and the selector lever is in the parking position) has been met is judged. When judging that the remote starting condition has been met, the ACC relay 16, IG relay 17 and ST relay 18 are rendered in the ON state so as to provide an ACC signal, an IG signal and a starter signal to an engine controller 3. Here, the ACC relay 16 and IG relay 17 are kept in the ON state until the engine is stopped, while the ST relay 18 is kept in the ON state for a few seconds (e.g. 2-3 seconds).

Figure 13:
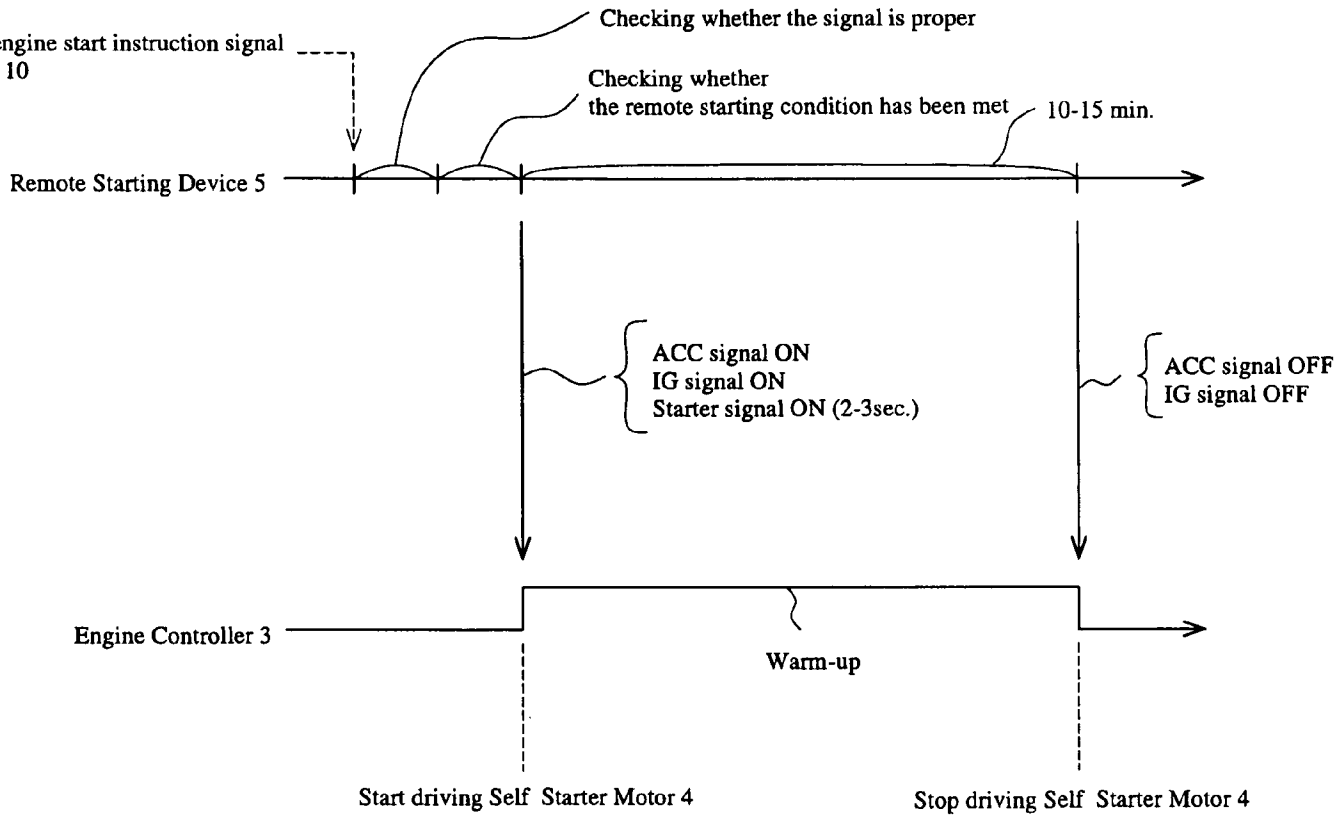
FIG. 13 is a timing chart showing a flow from the reception of a signal instructing to start the engine transmitted from the transmitter through an engine start up to an engine stop.

When a preset time $t_0$ (e.g. 10-15 minutes) elapsed with the remote starting condition kept satisfied after an engine start, the remote starting device 11 renders the ACC relay 16 and IG relay 17 in the OFF state so as to stop providing the ACC signal and IG signal to the engine controller 3. Here, a timing chart from the reception of a signal instructing to start the engine sent from the portable transmitter 21 through an engine start up to an engine stop is similar to that shown in FIG. 13.

Figure 2:
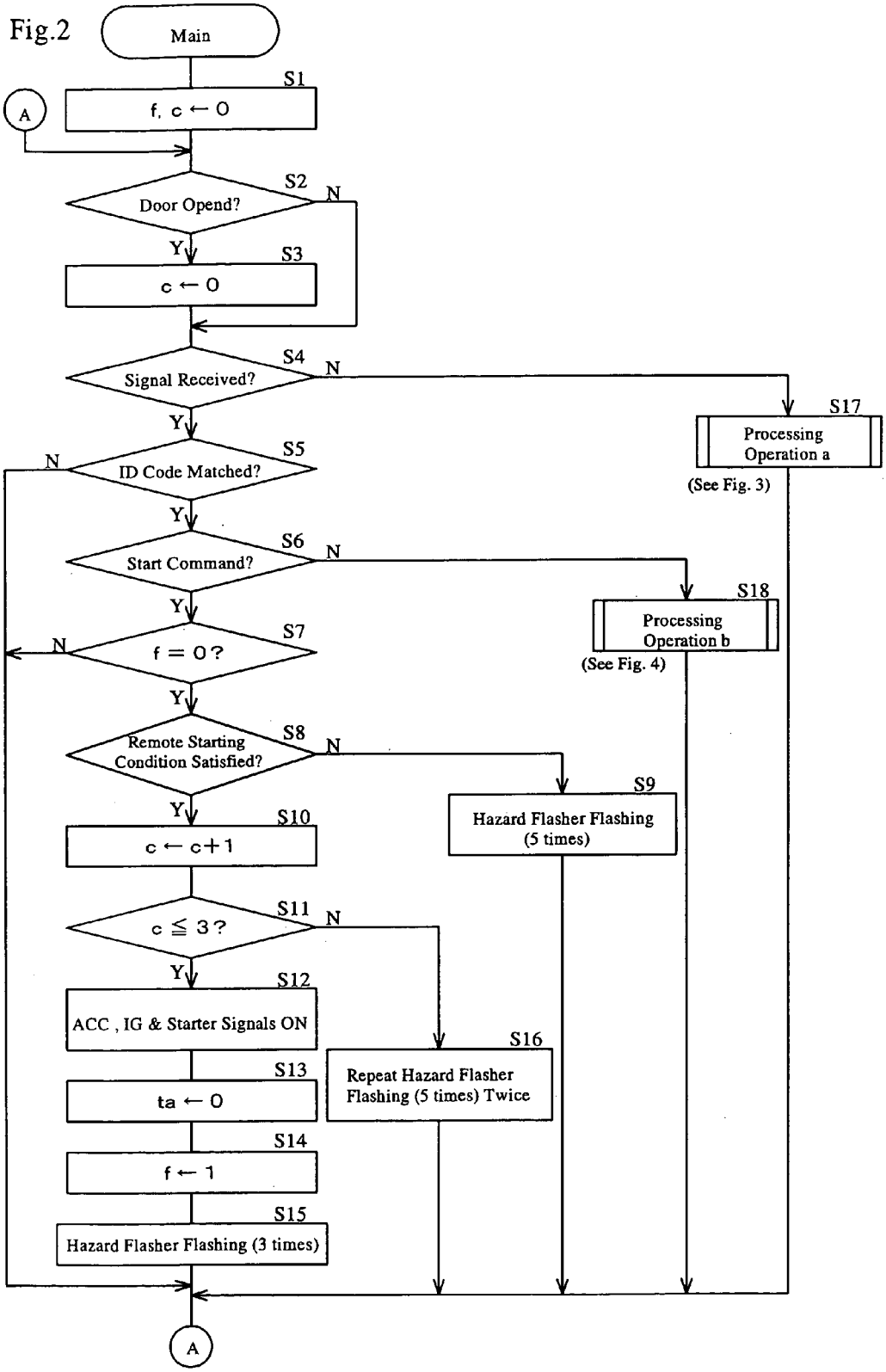
FIG. 2 is a flow chart showing the processing operation performed by a microcomputer in the remote starting device according to the first embodiment.

The processing operation performed by the microcomputer 12 in the remote starting device 11 according to the first embodiment is described by reference to flow charts shown in FIGS. 2-4. First, as initialization, a flag f for indicating whether the engine has been started by remote control and a counter c for counting the number of times of engine starting are set at 0 (Step 1).

In order to detect getting-on/-off the vehicle of the user, whether a door was opened or not is judged based on information obtained from the door opening/closing detector 7 (Step 2). When it is judged that a door was opened (or that the user got out of the vehicle, or that the user got on the vehicle, in other words, that the user is near the vehicle), the counter c is reset at 0 so as to return to a state where the engine starting can be freshly conducted a prescribed number of times $c_1$ (e.g. $c_1$=3) (Step 3), and then, the operation goes to Step 4. On the other hand, when it is judged that no door is opened, the counter c cannot be reset, so that the operation bypasses Step 3 and directly goes to Step 4.

Here, as a condition for resetting the counter c at 0 (or a condition for resetting an engine starting situation decision), the opening of the door is adopted (see Steps 2 and 3), but the resetting condition is not limited to the opening of the door. In a remote starting device according to another embodiment, for example, an event showing that the user actually got on the vehicle such as the opening/closing of the door (including not only the opening of the door but also the closing thereof), an insertion of the ignition key 1 into the key cylinder 2, turning-on of an ACC switch, turning-on of an IG switch, no application of the parking brake or a shift of the selector lever to any position other than the parking position may be adopted, or these may be combined.

Whether a signal was received through the antenna 13 and receiving section 14 is judged in Step 4. When it is judged that a signal was received, whether an ID code included in the received signal matches the ID code stored in the EEPROM 15 is judged (Step 5). On the other hand, when it is judged that no signal has been received, the operation goes to Step 17, wherein the processing operation a (see FIG. 3) is conducted, and then, returns to Step 2.

When it is judged that the ID code included in the received signal is identical to the ID code stored in the EEPROM 15 (or that a signal transmitted from the portable transmitter 21 being carried by the authorized user was received), whether an engine start command code is included in the signal sent from the portable transmitter 21 is judged (Step 6). On the other hand, when it is judged that the ID code included in the received signal is not identical to the ID code stored in the EEPROM 15, the operation directly returns to Step 2 since the processing operations in Steps 6-16 and 18 are not required.

When it is judged that the engine start command code is included in the signal sent from the portable transmitter 21 in Step 6, whether the flag f is 0 or not is judged (Step 7). On the other hand, when it is judged that the engine start command code is not included therein, the operation goes to Step 18, wherein the processing operation b (see FIG. 4) is conducted, and then, returns to Step 2.

When it is judged that the flag f is 0 (or that the engine has not been started) in Step 7, whether the remote starting condition has been met is judged based on information obtained from each of the key detector 6, door opening/closing detector 7, parking brake application detector 8 and selector lever position detector 9 (Step 8). On the other hand, when it is judged that the flag f is not 0 (or that the engine has been already started), the operation directly returns to Step 2 since the processing operations in Steps 8-16 are not required.

When it is judged that the remote starting condition has not been met (or engine starting by remote control cannot be realized in the condition) in Step 8, in order to notify the user of that effect, the lamp lighting device 19 is controlled so as to flash the hazard flasher five times (Step 9), and then, the operation returns to Step 2.

On the other hand, when it is judged that the remote starting condition has been met, 1 is added to the counter c (Step 10). Whether the counter c to which 1 was added reads a prescribed number of times $c_1$ (e.g. $c_1$=3) or less is judged (Step 11). When it is judged that the counter c reads 3 or less, or that the number of times of the engine starting has not reached three times yet since the last opening of the door (the counter c is reset at 0 when the door was opened as described in Steps 2 and 3), the prohibition of engine starting is not required. Therefore, in order to activate a self starter motor 4, the ACC relay 16, IG relay 17 and ST relay 18 are rendered in the ON state so as to provide an ACC signal, an IG signal and a starter signal to the engine controller 3 (Step 12).

A timer ta for measuring an elapsed time after an engine start is reset at 0 and is started up (Step 13). The flag f is turned to 1 (Step 14), and in order to notify the user that the engine was started by remote control, the lamp lighting device 19 is controlled so as to flash the hazard flasher three times (Step 15). Thereafter, the operation returns to Step 2. That is, the engine start by remote control is notified in a manner different from the case of notifying that the engine start by remote control cannot be realized in the condition.

On the other hand, when it is judged that the counter c reads more than 3 (or that the number of times of the engine starting since the last opening of the door has already reached three times) in Step 11, it is decided that the engine starting has been frequently conducted though a situation where the user does not get on the vehicle continues. In order to notify the user that the engine start by remote control is not acceptable because of the decision, the lamp lighting device 19 is controlled so as to repeat 5 flashes of the hazard lamp twice (Step 16). Thereafter, the operation returns to Step 2. Thus, the engine starting is limited so that the number of times of the engine starting is three times at the maximum. Since this form of notification that the engine starting by remote control cannot be realized in the condition is different from the form of notification in the case where the remote starting condition has not been met, it is possible to inform the user of the reason why the engine start is not realized.

Figure 3:
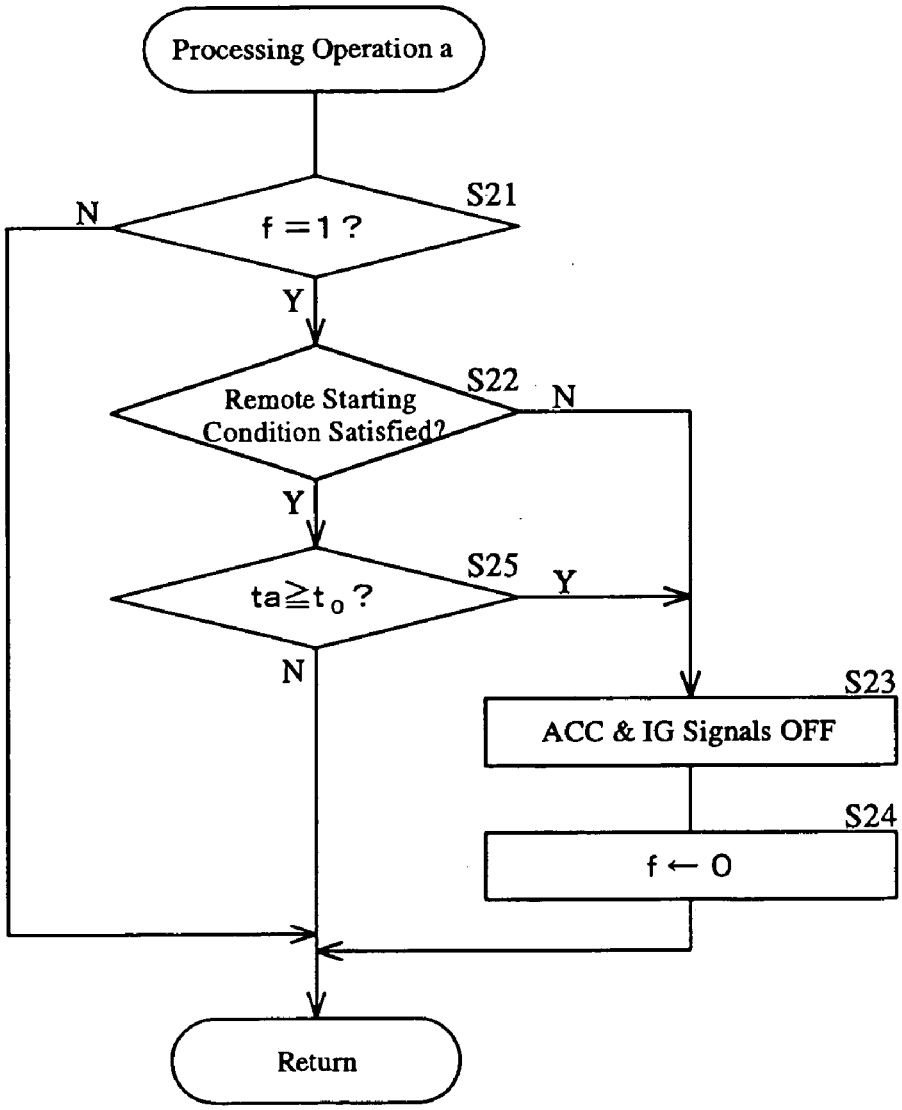
FIG. 3 is a flow chart showing the processing operation performed by the microcomputer in the remote starting device according to the first embodiment.

In the processing operation a shown in FIG. 3, whether the flag f is 1 or not is judged (Step 21). When it is judged that the flag f is 1 (or that the engine has been started), whether the remote starting condition has been met is judged based on information obtained from each of the key detector 6, door opening/closing detector 7, parking brake application detector 8 and selector lever position detector 9 (Step 22). On the other hand, when it is judged that the flag f is not 1, the processing operation a is ended at once since the processing operations in Steps 22-25 are not required.

When it is judged that the remote starting condition has not been met (or that the engine starting by remote control is not realized in the condition) in Step 22, the ACC relay 16 and IG relay 17 are rendered in the OFF state so as to stop providing the ACC signal and IG signal to the engine controller 3 (Step 23). Thereafter, the flag f is returned to 0 (Step 24).

On the other hand, when it is judged that the remote starting condition has been met, whether the timer ta has counted to a preset time $t_0$ (e.g. 10-15 minutes) or more is judged (Step 25). When it is judged that the timer ta has counted to the preset time $t_0$ or more (or that 10-15 minutes has elapsed since the engine was started by remote control), in order to stop the engine, the ACC relay 16 and IG relay 17 are turned to the OFF state so as to stop providing the ACC signal and IG signal to the engine controller 3 (Step 23). Thereafter, the flag f is returned to 0 (Step 24).

Figure 4:
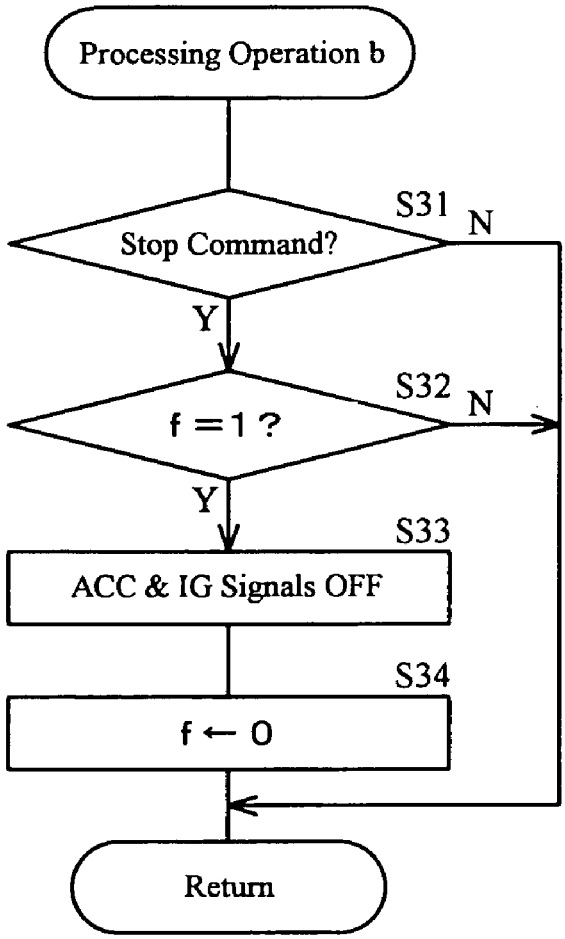
FIG. 4 is a flow chart showing the processing operation performed by the microcomputer in the remote starting device according to the first embodiment.

In the processing operation b shown in FIG. 4, whether an engine stop command code is included in the signal sent from the portable transmitter 21 is judged (Step 31). When it is judged that the engine stop command code is included in the signal sent from the portable transmitter 21, whether the flag f is 1 or not is judged (Step 32). On the other hand, when it is judged that the engine stop command code is not included therein, the processing operation b is ended at once since the processing operations in Steps 32-34 are not required.

When it is judged that the flag f is 1 (or that the engine has been started) in Step 32, in order to stop the engine, the ACC relay 16 and IG relay 17 are turned to the OFF state so as to stop providing the ACC signal and IG signal to the engine controller 3 (Step 33). Thereafter, the flag f is returned to 0 (Step 34). On the other hand, when it is judged that the flag f is not 1, the processing operation b is ended at once since the processing operations in Steps 33 and 34 are not required.

Using the remote starting device according to the above first embodiment, when the number of times c of the engine starting is more than the prescribed number of times $c_1$ (e.g. 3 times), so that it is decided that the engine starting has been frequently conducted (or there is a possibility that a warm-up continues for a long time, or there is a possibility that the total time of warm-ups becomes long even if they were intermittently conducted), the engine starting through receiving the engine start command from the portable transmitter 21 is prohibited. That is, when the number of times of the engine starting by remote control within the preset period of time exceeds the prescribed number of times, the engine operation by remote control is prohibited.

Thus, for example, it is possible to prevent a fourth engine start from being conducted by the engine start command from the portable transmitter 21 (or by remote control). Therefore, it is possible to prevent the engine starting from being frequently conducted though a situation where the user does not get on the vehicle continues, so that it is possible to certainly avoid a warm-up from continuing for a long time.

Here, the decision on whether the warm-up is continuing for a long time, or the decision on whether the total time of warm-ups are long is made based on the number of times of the engine starting. But in another embodiment, the cumulative running time of the engine (the total time of warm-ups) may be actually measured using the timer ta for measuring an elapsed time after an engine start, and these decisions may be made based on the actual cumulative running time of the engine.

When a door is opened and it is judged that the user is near the vehicle, or that the user is on the vehicle, the counter c is reset at 0, resulting in a return to a situation where the engine starting can be freshly conducted three times. Therefore, it is possible to prevent the prohibition of engine starting more than necessary. Thus, the convenience can be improved with keeping the safety of the engine starting by remote control.

Here, the engine starting is limited in response to the frequency of the engine starting by remote control (or the cumulative running time of the engine) within the period of time from the opening of the door to the next opening of the door. But in another embodiment, the engine starting may be limited in response to the frequency of the engine starting by remote control (or the cumulative running time of the engine) within the period of time from the closing of the door to the next opening of the door.

In the remote starting device according to the above first embodiment, the closing of the doors is included in the remote starting condition. Therefore, the frequency of the engine starting by remote control (or the cumulative running time of the engine) within the period of time from the opening of the door to the next opening of the door is substantially the same as the frequency of the engine starting by remote control (or the cumulative running time of the engine) within the period of time from the closing of the door to the next opening of the door.

In the remote starting device according to the above first embodiment, the remote starting is limited based on the number of times of the remote starting within the period of time from the opening of the door to the next opening of the door. For example, when the number of times of the remote starting within the period of time exceeds the prescribed number of times, the remote starting is limited. But in another embodiment, not only when the number of times of the remote starting exceeds the prescribed number of times, but also when the cumulative running time of the engine by the remote starting within the period of time exceeds a preset time, the remote starting may be limited.

A remote starting device according to a second embodiment is described below. Here, since the remote starting device 11A according to the second embodiment has the same construction as the remote starting device 11 shown in FIG. 1 except for the microcomputer 12, a microcomputer is differently marked and other components are not described below.

Reference numeral 11A in the figure represents a remote starting device, comprising a microcomputer 12A, an antenna 13 and a receiving section 14 for receiving signals sent from a portable transmitter 21, an EEPROM 15 in which an ID code is stored, an ACC relay 16, an IG relay 17 and a ST relay 18.

Figure 5:
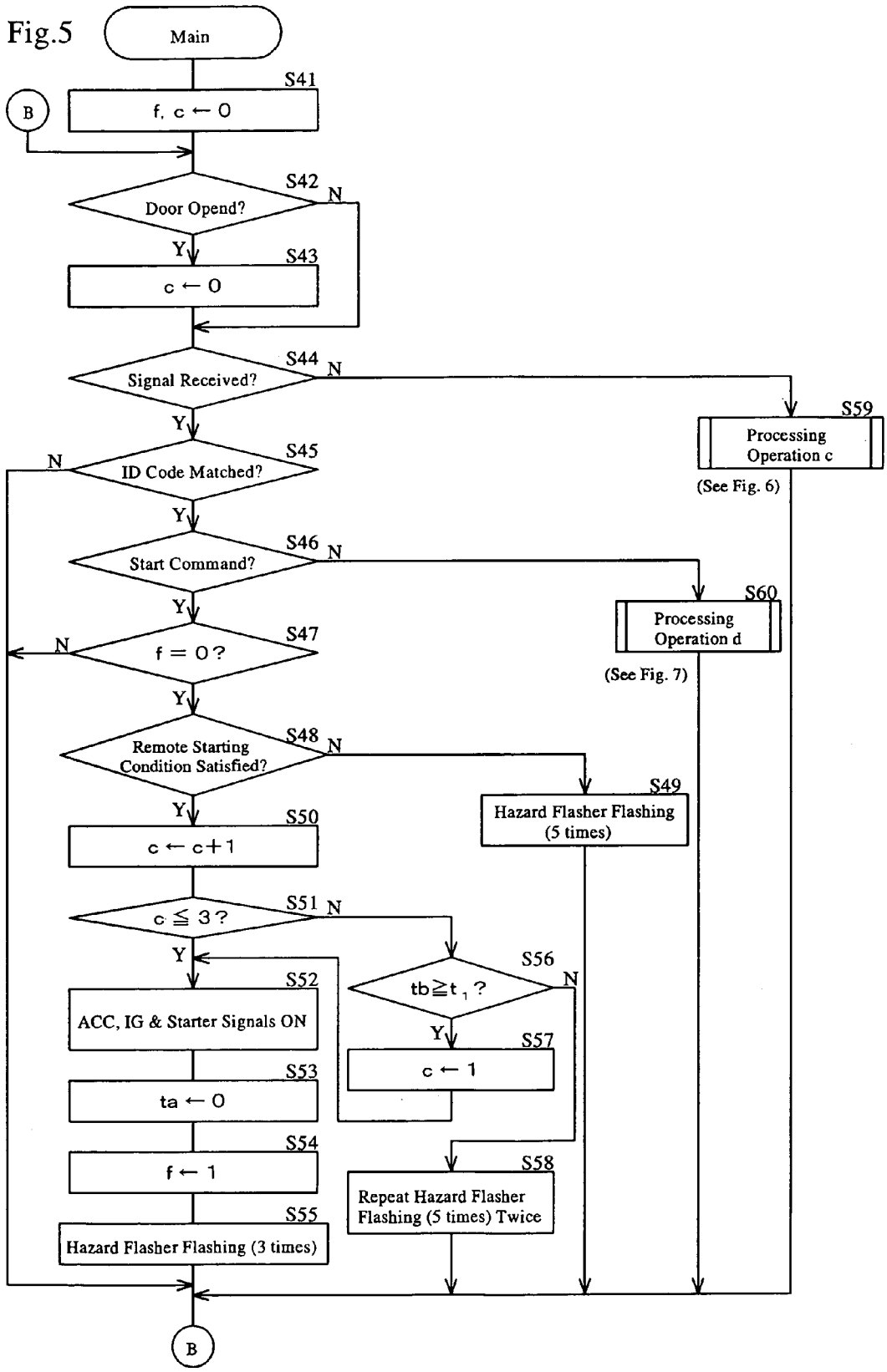
FIG. 5 is a flow chart showing the processing operation performed by a microcomputer in a remote starting device according to a second embodiment.
Figure 6:
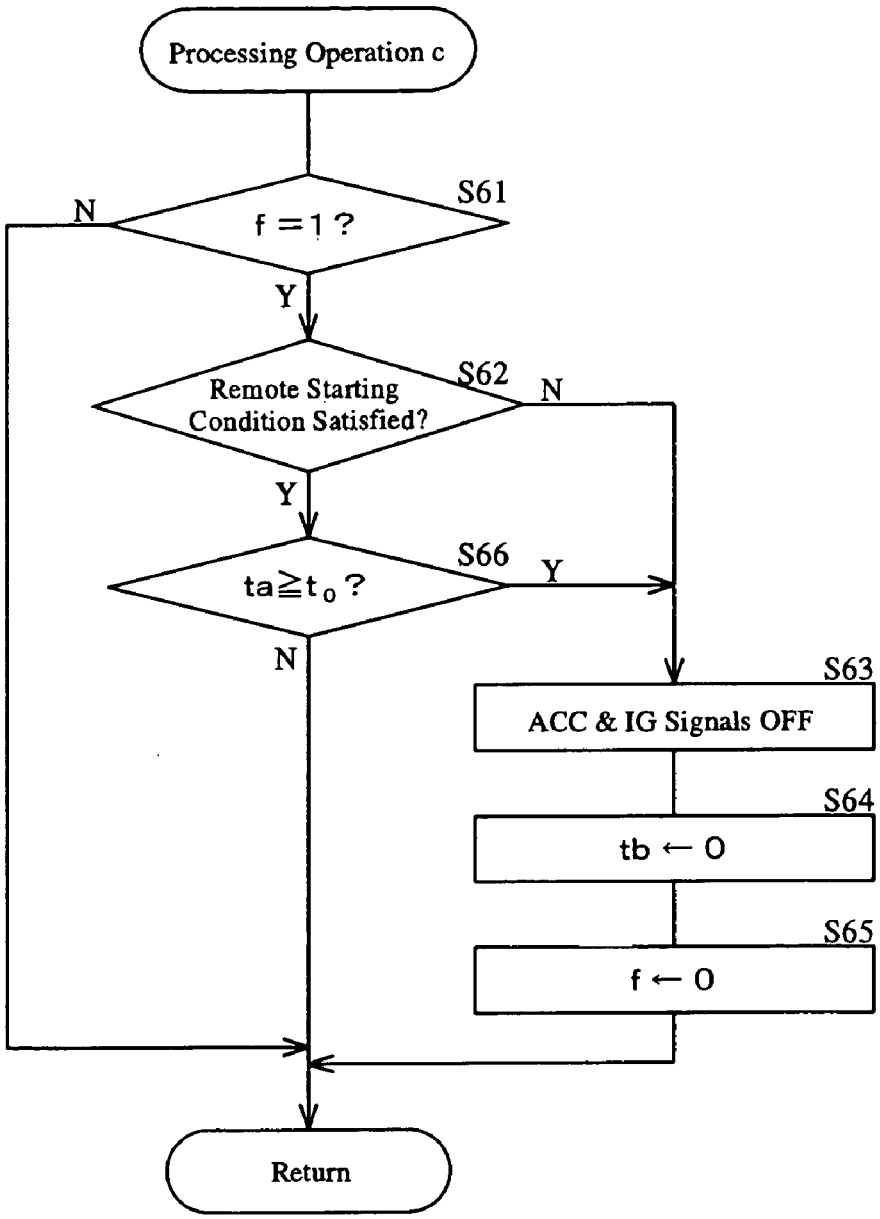
FIG. 6 is a flow chart showing the processing operation performed by the microcomputer in the remote starting device according to the second embodiment.
Figure 7:
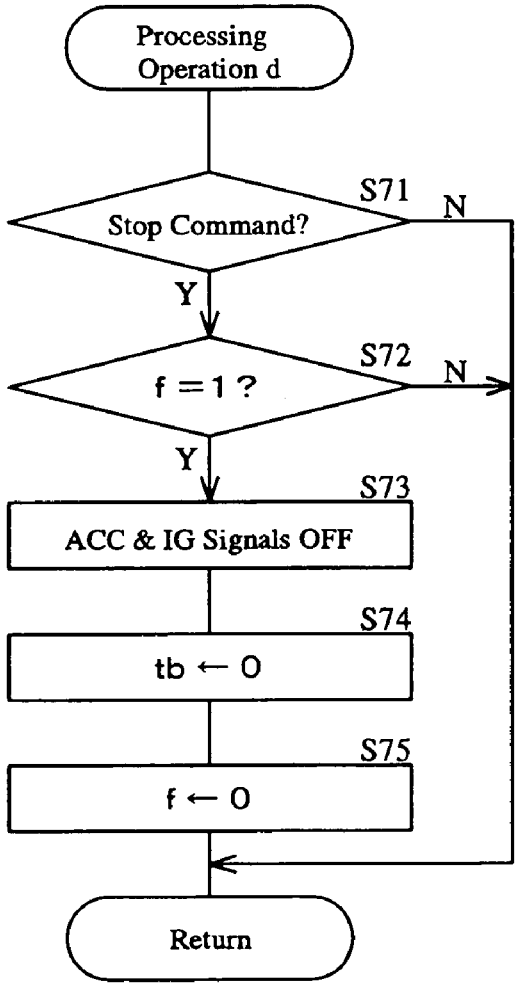
FIG. 7 is a flow chart showing the processing operation performed by the microcomputer in the remote starting device according to the second embodiment.

The processing operation performed by the microcomputer 12A in the remote starting device 11A according to the second embodiment is described by reference to flow charts shown in FIGS. 5-7. Here, since the processing operation performed by the microcomputer 12A and the processing operation performed by the microcomputer 12 shown in FIGS. 2-4 have many common portions, a part of them is not described below.

First, the processing operation c (see FIG. 6) to be conducted when it is judged that no signal has been received in Step 44 and the operation goes to Step 59 is described. The difference between the processing operation c and the processing operation a shown in FIG. 3 is that in order to stop an engine, the ACC relay 16 and IG relay 17 are turned to the OFF state so as to stop providing an ACC signal and an IG signal to an engine controller 3 (Step 63), and thereafter, a timer tb for measuring an elapsed time after an engine stop is reset at 0 and is started up (Step 64).

The processing operation d (see FIG. 7) to be conducted when it is judged that an engine start command code is not included in a signal sent from the portable transmitter 21 in Step 46 (FIG. 5) and the operation goes to Step 60 is described. The difference between the processing operation d and the processing operation b shown in FIG. 4 is that in order to stop the engine, the ACC relay 16 and IG relay 17 are turned to the OFF state so as to stop providing the ACC signal and IG signal to the engine controller 3 (Step 73), and thereafter, the timer tb for measuring an elapsed time after an engine stop is reset at 0 and is started up (Step 74), being similar to the difference between the processing operation c and the processing operation a.

When it is judged that the counter c reads more than 3 (or that the number of times of the engine starting has already reached three times since the last opening of the door) in Step 51 (FIG. 5), whether the timer tb has counted to a preset time $t_1$ (e.g. 30 minutes) or more is judged (Step 54). When it is judged that the timer tb has counted to 30 minutes or more (or that a measure of time has elapsed since the last engine stop), it is decided that the engine starting does not come to be frequently conducted even with the next engine start. The counter c is turned to 1 (Step 57) and then, the operation goes to Step 52, wherein the processing operation for activating a self starter motor 4 is conducted.

On the other hand, when it is judged that the timer tb has counted to less than 30 minutes (or that the number of times of the engine starting has already reached three times since the last opening of the door and that not so long time has elapsed since the last engine stop) in Step 56, it is decided that the engine starting comes to be frequently conducted due to this engine start. A notification processing for notifying the user that the engine start by remote control is not acceptable because of the decision is conducted (Step 58), and then, the operation returns to Step 42.

Using the remote starting device according to the second embodiment, if the number of times of the engine starting has already reached three times since the last opening of the door and not so long time has elapsed since the last engine stop, it is decided that the engine starting comes to be frequently conducted due to this engine start (or that there is a possibility that the total time of warm-ups becomes long even if they were intermittently conducted). As a result, the engine starting through receiving the engine start command from the portable transmitter 21 is prohibited.

In other words, even if the number of times of the engine starting has already reached three times, the engine starting through receiving the engine start command from the portable transmitter 21 is not prohibited when a measure of time has elapsed since the last engine stop. Thus, it is possible not only to ensure the safety of the engine starting by remote control but also to further improve the convenience.

Here, the judgment on whether the preset time $t_1$ (e.g. 30 minutes) has elapsed since the last engine stop is made using the timer tb for measuring an elapsed time after an engine stop (which is reset at 0 when the engine was stopped), but how to judge whether the preset time $t_1$ has elapsed since the last engine stop is not limited to the use of the timer tb.

In a remote starting device according to another embodiment, for example, by determining whether a preset time $T_1$ ($=t_0+t_1$) has elapsed since the last engine start using a timer T for measuring an elapsed time after the last engine start (which is reset at 0 when the engine was started), whether the preset time $t_1$ has elapsed since the last engine stop may be judged. When a preset time $t_0$ (or a warm-up time) is 15 minutes, the preset time $T_1$ is 45 minutes.

A remote starting device according to a third embodiment is described below. Here, since the remote starting device 11B according to the third embodiment has the same construction as the remote starting device 11 shown in FIG. 1 except for the microcomputer 12, a microcomputer is differently marked and other components are not described below.

Reference numeral 11B in the figure represents a remote starting device, comprising a microcomputer 12B, an antenna 13 and a receiving section 14 for receiving signals sent from a portable transmitter 21, an EEPROM 15 in which an ED code is stored, an ACC relay 16, an IG relay 17 and a ST relay 18.

Figure 8:
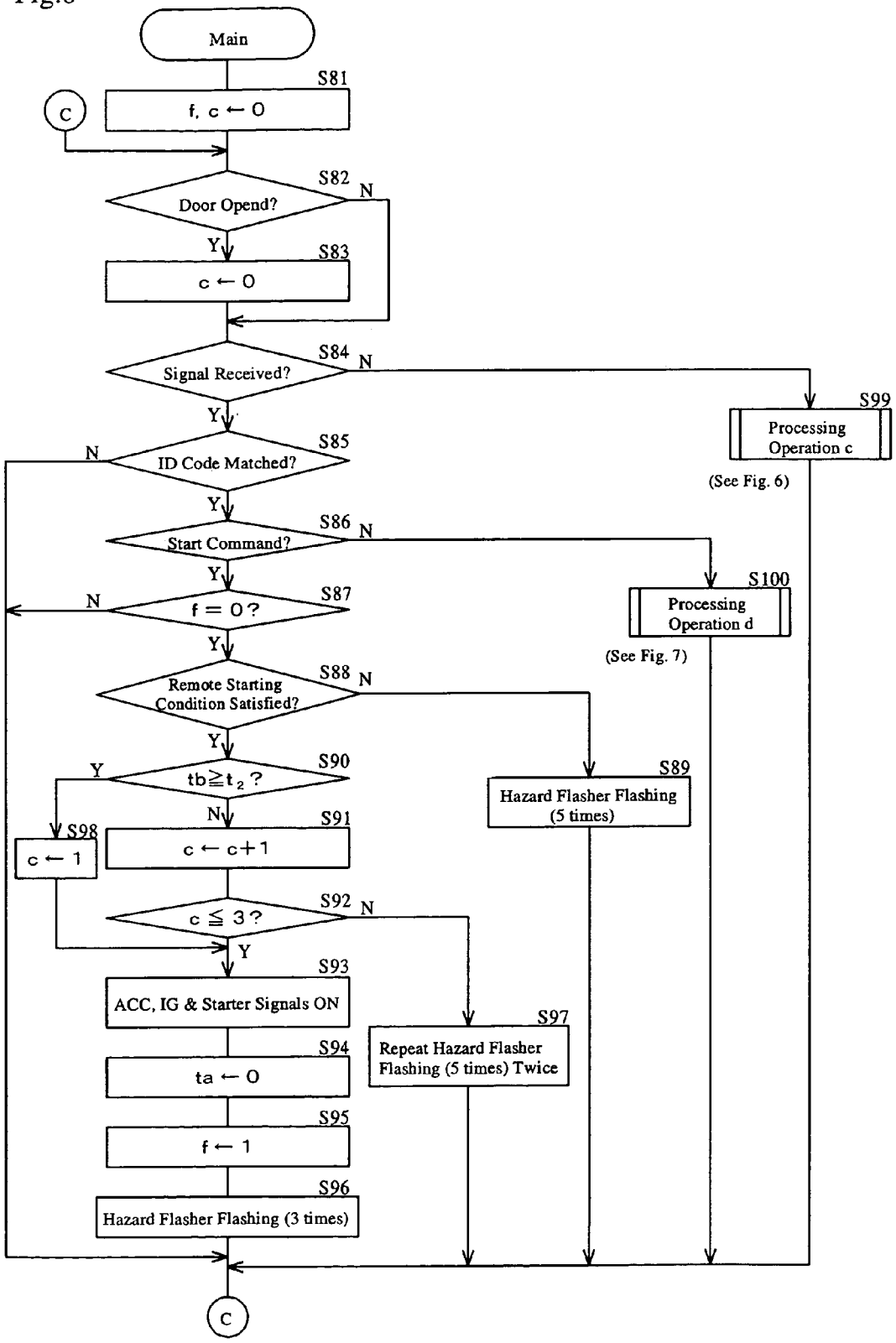
FIG. 8 is a flow chart showing the processing operation performed by a microcomputer in a remote starting device according to a third embodiment.

The processing operation performed by the microcomputer 12B in the remote starting device 11B according to the third embodiment is described by reference to a flow chart shown in FIG. 8. Here, since the processing operation performed by the microcomputer 12B and the processing operation performed by the microcomputer 12A shown in FIG. 5 have many common portions, a part of them is not described below.

When it is judged that a remote starting condition has been met in Step 88, whether a timer tb for measuring an elapsed time after an engine stop has counted to a preset time $t_2$ (e.g. 30 minutes) or more is judged (Step 90). When it is judged that the timer tb has not counted to 30 minutes or more (or not so long time has elapsed since the last engine stop), 1 is added to a counter c (Step 91). Whether the counter c to which 1 was added reads a prescribed number of times $c_2$ (e.g. $c_2=3$) or less is judged (Step 92). When it is judged that the counter c reads 3 or less (or the number of times of the engine starting has not reached 3 times yet since the last opening of a door), in order to activate a self starter motor 4, the ACC relay 16, IG relay 17 and ST relay 18 are turned to the ON state so as to provide an ACC signal, an IG signal and a starter signal to an engine controller 3 (Step 93).

On the other hand, when it is judged that the timer tb has counted to 30 minutes or more (or a measure of time has elapsed since the last engine stop) in Step 90, it is decided that the engine starting does not come to be frequently conducted and the counter c is turned to 1 (Step 98). Thereafter, the operation goes to Step 93, wherein the processing operation for activating the self starter motor 4 is conducted.

Using the remote starting device according to the above third embodiment, when it is judged that the number of times of the engine starting within the preset time $t_2$ (e.g. 30 minutes) after the last engine stop is the prescribed number of times $c_2$ (e.g. 3 times)(or when the engine starting has been repeated at short intervals) and it is decided that the engine starting comes to be repeatedly conducted due to this engine start (e.g. a fourth engine start) (or when there is a possibility that the total time of warm-ups becomes long even if they were intermittently conducted), the engine starting through receiving an engine start command from the portable transmitter 21 is prohibited.

Thus, for example, when the engine starting was repeated three times at short intervals within 30 minutes, it is possible to prevent a fourth engine start from being conducted by the engine start command from the portable transmitter 21 (or by remote control). Therefore, since the engine starting cannot be conducted four times at short intervals, it is possible to certainly avoid a warm-up from continuing for a long time.

Here, the judgment on whether the preset time $t_2$ (e.g. 30 minutes) has elapsed since the last engine stop is made using the timer tb for measuring an elapsed time since an engine stop (which is reset at 0 when the engine was stopped), but how to judge whether the preset time $t_2$ has elapsed since the last engine stop is not limited to the use of the timer tb.

In a remote starting device according to another embodiment, for example, by determining whether a preset time $T_2$ ($=t_0+t_2$) has elapsed since the last engine start using a timer T for measuring an elapsed time since the last engine start (which is reset at 0 when the engine was started), whether the preset time $t_2$ has elapsed since the last engine stop may be judged. When a preset time $t_0$ (or a warm-up time) is 15 minutes, the preset time $T_2$ is 45 minutes.

Here, when the engine starting is repeated at short intervals, the engine starting by remote control is limited. But in another embodiment, the repetition of the engine starting at short intervals itself may be prohibited. For example, when the elapsed time from an engine stop to the next engine start is shorter than a preset time, the remote starting may be prohibited.

A remote starting device according to a fourth embodiment is described below. Here, since the remote starting device 11C according to the fourth embodiment has the same construction as the remote starting device 11 shown in FIG. 1 except for the microcomputer 12, a microcomputer is differently marked and other components are not described below.

Reference numeral 11C in the figure represents a remote starting device, comprising a microcomputer 12C, an antenna 13 and a receiving section 14 for receiving signals sent from a portable transmitter 21, an EEPROM 15 in which an ID code is stored, an ACC relay 16, an IG relay 17 and a ST relay 18.

Figure 9:
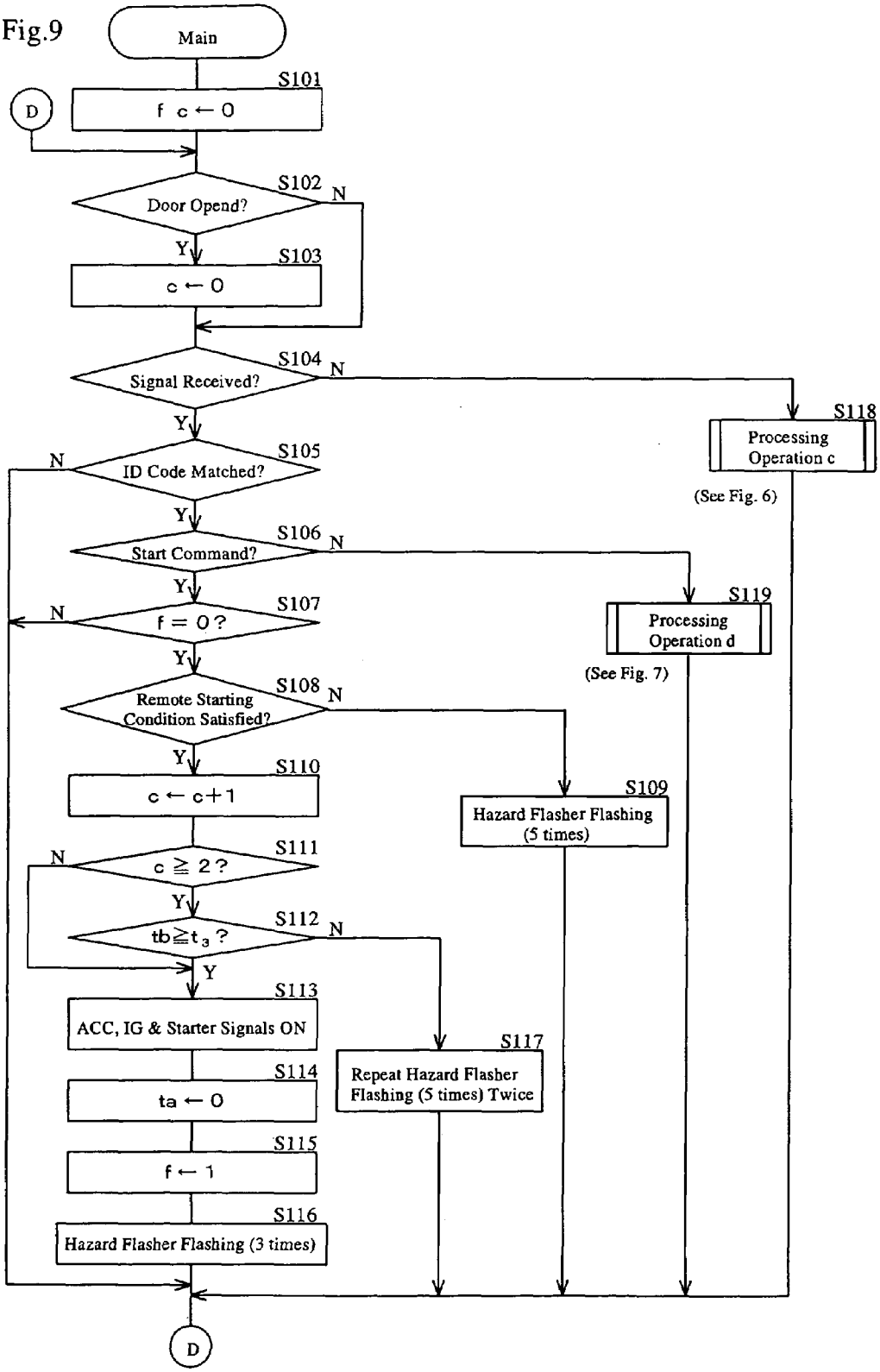
FIG. 9 is a flow chart showing the processing operation performed by a microcomputer in a remote starting device according to a fourth embodiment.

The processing operation performed by the microcomputer 12C in the remote starting device 11C according to the fourth embodiment is described by reference to a flow chart shown in FIG. 9. Here, since the processing operation performed by the microcomputer 12C and the processing operation performed by the microcomputer 12A shown in FIG. 5 have many common portions, a part of them is not described below.

When it is judged that a remote starting condition has been met in Step 108, 1 is added to a counter c (Step 110). Whether the counter c to which 1 was added reads 2 or more (or whether the engine start is a second one or later when counting is started at the first engine start after the last opening of a door) is judged (Step 111). When it is judged that the counter c reads 2 or more, whether a timer tb for measuring an elapsed time after an engine stop has counted to a preset time $t_3$ (e.g. 30 minutes) or more is judged (Step 112). When it is judged that the timer tb has counted to 30 minutes or more (or a measure of time has elapsed since the last engine stop), in order to activate a self starter motor 4, the ACC relay 16, IG relay 17 and ST relay 18 are turned to the ON state so as to provide an ACC signal, an IG signal and a starter signal to an engine controller 3 (Step 113).

On the other hand, when it is judged that the timer tb has not counted to 30 minutes or more (or not so long time has elapsed since the last engine stop), it is decided that the engine starting comes to be frequently conducted due to this engine start. The notification processing for notifying the user that the engine starting by remote control is not acceptable because of the decision is conducted (Step 117), and then, the operation returns to Step 102. When it is judged that the counter c reads less than 2 in Step 111, the operation bypasses Step 112 and directly goes to Step 113, wherein the processing operation for activating the self starter motor 4 is conducted.

Using the remote starting device according to the above fourth embodiment, when it is judged that the elapsed time between the last engine stop and this engine start is the preset time $t_3$ (e.g. 30 minutes) or less (or when the engine starting comes to be repeated at short intervals), it is decided that the engine starting comes to be frequently conducted due to this engine start. Thus, for example, it is possible to prevent the engine starting from being repeated at short intervals within 30 minutes, so that it is possible to certainly avoid the total time of warm-ups from becoming long even if they were conducted intermittently.

Here, the judgment on whether the preset time $t_3$ (e.g. 30 minutes) has elapsed since the last engine stop is made using the timer tb for measuring an elapsed time since an engine stop (which is reset at 0 when the engine was stopped), but how to judge whether the preset time $t_3$ has elapsed since the last engine stop is not limited to the use of the timer tb.

In a remote starting device according to another embodiment, for example, by determining whether a preset time $T_3$ ($=t_0+t_3$) has elapsed since the last engine start using a timer T for measuring an elapsed time after the last engine start (which is reset at 0 when the engine was started), whether the preset time $t_3$ has elapsed since the last engine stop may be judged. When a preset time $t_0$ (or a warm-up time) is 15 minutes, the preset time $T_3$ is 45 minutes.

A remote starting device according to a fifth embodiment is described below. Here, since the remote starting device 11D according to the fifth embodiment has the same construction as the remote starting device 11 shown in FIG. 1 except for the microcomputer 12, a microcomputer is differently marked and other components are not described below.

Reference numeral 11D in the figure represents a remote starting device, comprising a microcomputer 12D, an antenna 13 and a receiving section 14 for receiving signals sent from a portable transmitter 21, an EEPROM 15 in which an ID code is stored, an ACC relay 16, an IG relay 17 and a ST relay 18.

Figure 10:
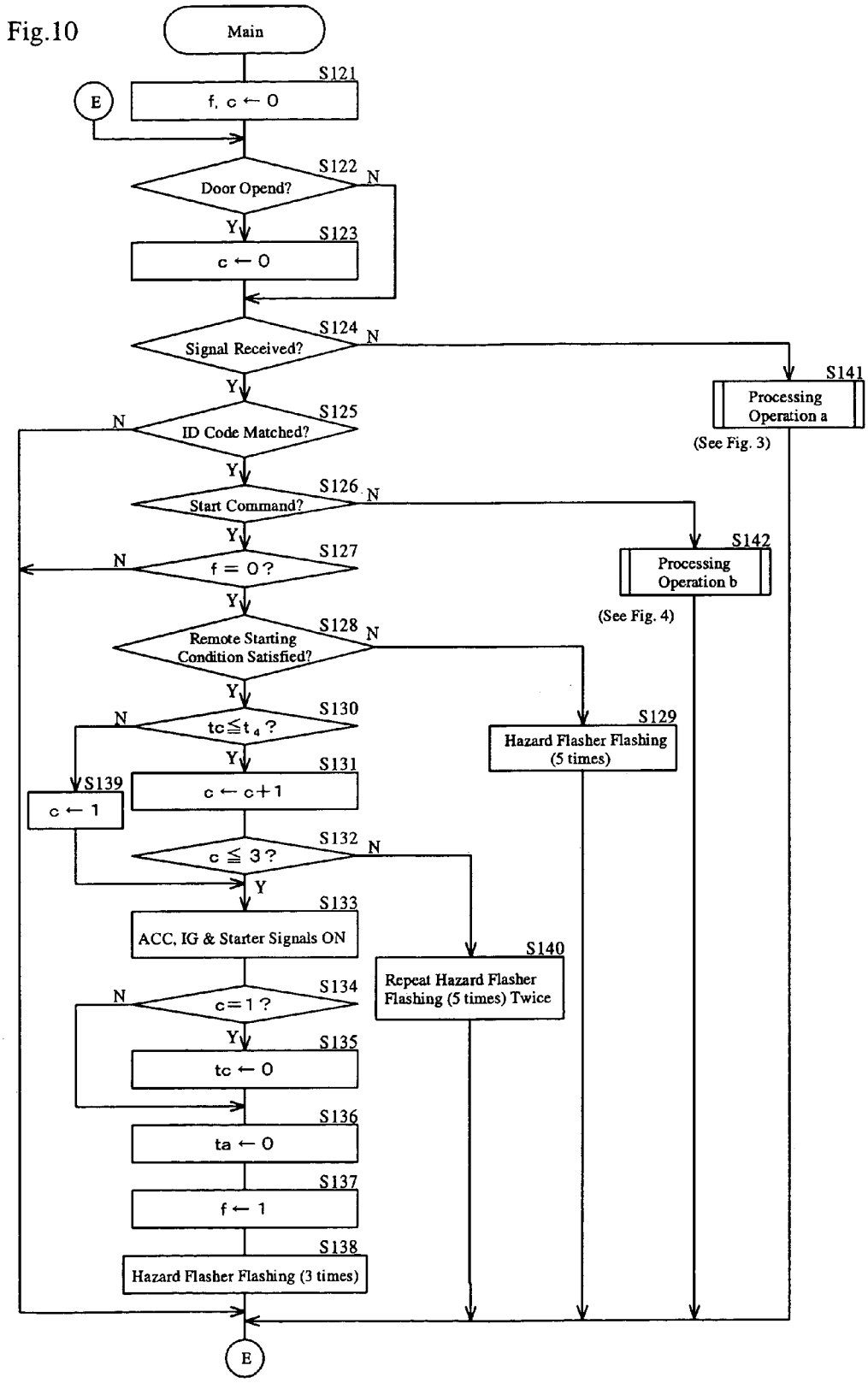
FIG. 10 is a flow chart showing the processing operation performed by a microcomputer in a remote starting device according to a fifth embodiment.

The processing operation performed by the microcomputer 12D in the remote starting device 11D according to the fifth embodiment is described by reference to a flow chart shown in FIG. 10. Here, since the processing operation performed by the microcomputer 12D and the processing operation performed by the microcomputer 12 shown in FIG. 2 have many common portions, a part of them is not described below.

When it is judged that a remote starting condition has been met in Step 128, whether a timer tc for measuring an elapsed time after a certain engine start (see Step 135) has counted to a preset time $t_4$ (e.g. 60 minutes) or less is judged (Step 130). When it is judged that the timer tc has counted to 60 minutes or less, 1 is added to a counter c (Step 131). Whether the counter c to which 1 was added reads not more than a prescribed number of times $c_3$ (e.g. $c_3$=3) is judged (Step 132). When it is judged that the counter c reads more than 3 (or the number of times of the engine starting has reached three times before 60 minutes elapses), it is decided that the engine starting comes to be frequently conducted due to a fourth engine start. The notification processing for notifying the user that the engine starting by remote control is not acceptable because of the decision is conducted (Step 140), and the operation returns to Step 122. Thus, the number of times of the engine starting within 60 minutes is limited to three times at the maximum.

On the other hand, when it is judged that the counter c reads 3 or less in Step 132, in order to activate a self starter motor 4, the ACC relay 16, IG relay 17 and ST relay 18 are turned to the ON state so as to provide an ACC signal, an IG signal and a starter signal to an engine controller 3 (Step 133). And whether the counter c is 1 or not is judged (Step 134). Here, the counter c is reset at 0 in Step 123, or turned to 1 in Step 139, so that the number of times of the engine starting is recounted.

When it is judged that the counter c reads 1 (or that this engine start becomes a first one by recounting), in order to measure an elapsed time after this engine start, a timer tc is reset at 0 and is started up (Step 135), and then, the operation goes to Step 136. On the other hand, when it is judged that the counter c reads not 1, the operation bypasses Step 135 and goes to Step 136.

When it is judged that the timer tc has counted to more than 60 minutes (or 60 minutes has elapsed since a certain engine start) in Step 130, in order to return to a state where the engine starting can be freshly conducted 3 times, the counter c is reset at 1 (Step 139), and then, the operation goes to Step 133.

Using the remote starting device according to the above fifth embodiment, when it is judged that the number of times of the engine starting within the preset time $t_4$ (for example, within 60 minutes from the first engine start after the user went away from the vehicle) becomes four times due to the next engine start, it is decided that the engine start comes to be frequently conducted. For example, it is possible to prohibit the engine starting from being conducted four times within 60 minutes, being not so long. Thus, it is possible to prevent the temperature of exhaust gas from becoming too high, or the amount of toxic gas around the vehicle from becoming too large.

Here, in the remote starting device according to the above fifth embodiment, the time interval between the last engine stop and this engine start is not limited, but in a remote starting device according to another embodiment, for example, a condition that an elapse of a preset time (e.g. 5 minutes) between the last engine stop and this engine start is required may be added. Or only the time interval between a new first engine start after recounting and the preceding engine stop may be limited.

Here, the judgment on whether the preset time $t_4$ (e.g. 60 minutes) has elapsed since the first engine start after the user went away from the vehicle is made using the timer tc for measuring an elapsed time after the first engine start (which is reset at 0 at the first engine start), but how to judge whether the preset time $t_4$ has elapsed since the first engine start is not limited to the use of the timer tc.

In a remote starting device according to another embodiment, for example, by determining whether a preset time $T'_1$ ($=t_4-t_0$) has elapsed since the first engine start was stopped using a timer T' for measuring an elapsed time since the first engine start was stopped (which is reset at 0 when the first engine start was stopped), whether the preset time $t_4$ has elapsed since the first engine start may be judged. When a preset time $t_0$ (or a warm-up time) is 15 minutes, the preset time $T'_1$ is 45 minutes.

In the remote starting devices according to the above first through fifth embodiments, the cases where the parameters, the prescribed numbers of times $c_1$-$c_3$ and the preset times $t_1$-$t_4$, are fixed are described, but these parameters need not be always fixed. In a remote starting device according to another embodiment, based on information about vehicle environments (such as the temperature of exhaust gas emitted from the vehicle, the amount of toxic gas around the vehicle, the temperature around the vehicle and the location where the vehicle is), these parameters may be set so that the threshold values for limiting the engine starting will be higher when the temperature of exhaust gas emitted from the vehicle is low, when the amount of toxic gas around the vehicle is small, when the temperature around the vehicle is low, or when the vehicle has been parked not within a garage but in an open wide space.

Here, the information about the temperature of exhaust gas emitted from the vehicle, the amount of toxic gas around the vehicle or the temperature around the vehicle can be obtained from sensors of each kind mounted on the vehicle, and the information about whether the vehicle is in the garage or not can be acquired from a navigation system or the like.

In the remote starting devices according to the above first through fifth embodiments, after the ACC relay 16, IG relay 17 and ST relay 18 are turned to the ON state in order to start the engine, the flag f is turned to 1, and after the ACC relay 16 and IG relay 17 are turned to the OFF state, the flag f is turned to 0. But in a remote starting device according to another embodiment, a signal from an alternator L terminal which outputs a high signal when the engine is running may be captured, and based on the actual running situation of the engine, the value of the flag f may be switched.

What is claimed is:

1. A remote starting device for controlling a starter for remote starting an engine of a vehicle in response to an engine start command from a transmitter, the remote starting device comprising:

a measuring section for measuring a cumulative running time of the engine by a plurality of remote starts of the engine; and a limiter for limiting the remote starting according to the cumulative running time measured by the measuring section.

2. A remote starting device of claim 1 wherein the limiter prevents further remote starting of the engine when the cumulative running time exceeds a predetermine period of time.

* * * * *